US012134502B2

(12) United States Patent
Salvador Zamora et al.

(10) Patent No.: US 12,134,502 B2
(45) Date of Patent: Nov. 5, 2024

(54) STRAW ASSEMBLY FOR LIQUID DISPENSER

(71) Applicant: Genicook Product LLC, Garland, TX (US)

(72) Inventors: Marc Salvador Zamora, Barcelona (ES); David Prieto de Sicart, Barcelona (ES)

( * ) Notice: Subject to any disclaimer, the term of this patent is extended or adjusted under 35 U.S.C. 154(b) by 69 days.

(21) Appl. No.: 17/648,107

(22) Filed: Jan. 14, 2022

(65) Prior Publication Data

US 2023/0227219 A1 Jul. 20, 2023

(51) Int. Cl.
*B65D 47/30* (2006.01)
*A45F 3/18* (2006.01)
*A47G 21/18* (2006.01)

(52) U.S. Cl.
CPC ..... *B65D 47/305* (2013.01); *A45F 3/18* (2013.01); *A47G 21/18* (2013.01)

(58) Field of Classification Search
CPC ..... B65D 47/305; A45F 3/18; A47G 21/18
USPC ..... 222/536
See application file for complete search history.

(56) References Cited

U.S. PATENT DOCUMENTS 4,485,963 A * 12/1984 Panicci ..... A47G 19/2266 222/536
6,145,695 A 11/2000 Garrigues
6,523,711 B1 2/2003 Hughes et al.
7,150,370 B2 12/2006 Pyun
8,147,685 B2 4/2012 Pritchard
9,643,199 B2 5/2017 Petkus et al.
9,694,953 B2 7/2017 Meyers et al.
10,214,328 B2 * 2/2019 Sorensen ..... B65D 43/22
10,898,017 B2 1/2021 Kalisz et al.
11,445,841 B2 * 9/2022 Prieto ..... A47G 23/0216
11,479,390 B1 * 10/2022 Salvador-Zamora ..... B65D 47/0857
11,772,850 B1 * 10/2023 Zamora ..... B65D 41/023 215/272
2012/0187075 A1 * 7/2012 El-Saden ..... B65D 51/242 215/389
2014/0048511 A1 * 2/2014 El-Saden ..... A47G 19/2266 215/389
2014/0061255 A1 * 3/2014 El-Saden ..... B65D 47/066 222/537
2015/0307265 A1 10/2015 Winn et al.
2016/0270570 A1 9/2016 Cardell
2017/0144809 A1 * 5/2017 Sorensen ..... B65D 43/16
2017/0188730 A1 * 7/2017 Schuller ..... A47G 19/2272
(Continued)

*Primary Examiner* — Paul R Durand
*Assistant Examiner* — Michael J. Melaragno
(74) *Attorney, Agent, or Firm* — Johnfar Kerlee

(57) ABSTRACT

Disclosed are embodiments of straw assemblies for use with liquid containers. In one embodiment, a straw assembly can include a lid coupler operatively coupled by a pivot rod to a straw coupler. In one embodiment, the pivot rod provides an axis of rotation for the lid coupler that is offset and parallel to a main axis of the straw assembly. In some embodiments, the lid coupler is configured to retain a valve and/or a gasket. In certain embodiments, the straw coupler can be configured to retain a seal. In one embodiment the lid coupler and the straw coupler can be provided with, respectively, a lid coupler hook and a straw coupler hook. The lid coupler hook and the straw coupler hook are configured to facilitate removable coupling of the lid coupler and the straw coupler.

19 Claims, 10 Drawing Sheets

(56) References Cited

U.S. PATENT DOCUMENTS

| | | | | |
|---|---|---|---|---|
| 2018/0192800 | A1* | 7/2018 | Coon | B65D 25/46 |
| 2019/0183269 | A1* | 6/2019 | Kalisz | A47G 19/2266 |
| 2022/0033148 | A1* | 2/2022 | Filiau | B65D 47/305 |
| 2022/0106084 | A1* | 4/2022 | Harris | A47G 21/186 |
| 2023/0227219 | A1* | 7/2023 | Zamora | A47G 21/18 222/536 |

* cited by examiner

STRAW ASSEMBLY FOR LIQUID DISPENSER

FIELD

Embodiments of the invention relate generally to portable, liquid dispensing containers. In particular, embodiments of the invention are directed to straw assemblies for dispensing a liquid.

BACKGROUND

Portable containers, such as tumblers, mugs, and the like, are commonly used to, for example, dispense liquids when walking, driving, or otherwise traveling. Portable containers typically include a container body and a lid that is removably coupled to the container body and includes a dispensing aperture.

Some portable containers include spouts. Spouts are generally movable, relative to the container body, between a stowed position and an in-use position. When the spout is in the in-use position, the contents of the container can be dispensed through the spout. When dispensing is no longer desired, the spout can be moved to the stowed configuration, whereby the contents are prevented from flowing out of the container.

Some portable containers may include a straw that couples to the lid and/or to the spout. In such containers, the passageway for dispensing the liquid may include a valve that is operatively coupled to the straw in some fashion.

There is a need in the relevant technology for lids and straws, for such containers, having a spout cover that can cover and protect, from dirt (for example), an inner space of the lid when the spout is in the in-use position. Furthermore there continues to be a need in the relevant technology for straw assemblies that, among other things, can facilitate the removal and cleaning of valves used in the dispensing passageway. Embodiments of the invention disclosed here satisfy these and other needs.

SUMMARY OF THE INVENTION

In one aspect, the invention is directed to a straw assembly having a lid coupler configured to couple to a lid of a container; a straw coupler configured to couple to a straw, the straw coupler configured for rotation relative to the lid coupler; and a pivot rod coupled to the lid coupler and to the straw coupler, the pivot rod configured to facilitate rotation of the lid coupler relative to the straw coupler. In one embodiment, the lid coupler includes a lid coupler tube having a passageway; a lid coupler base coupled to the lid coupler tube; wherein the lid coupler tube and/or the lid coupler base is configured with a cavity to receive a valve. In some embodiments, the straw coupler can include a straw coupler tube having a passageway; a straw coupler base coupled to the straw coupler tube; and wherein the straw coupler tube and/or the straw coupler base is configured with a cavity to receive a seal. In certain embodiments, the pivot rod provides an axis of rotation that is offset from and substantially parallel to a main axis of the straw assembly.

In one embodiment, the lid coupler further comprises a lid coupler hook, the straw coupler comprises a straw coupler hook, and the lid coupler hook and the straw coupler hook are configured to be removably coupled to one another. In certain embodiments, the straw coupler can further include a stop configured to stop a full rotation of the lid coupler relative to the straw coupler. In some embodiments, the lid coupler tube and/or the lid coupler base is further configured to receive a gasket.

In certain embodiments, the lid coupler base comprises a lid coupler base extension, the straw coupler base comprises a straw coupler base extension, and the lid coupler base extension and the straw coupler base extension are each configured to receive the pivot rod, and thereby operationally couple the lid coupler with the straw coupler.

Another aspect of the invention concerns a straw assembly for use with a portable water bottle. In one embodiment, the straw assembly can include a lid coupler configured to operatively couple to a fluid passageway of a lid of the portable water bottle; a straw coupler configured to operatively couple to the fluid passageway and to the lid coupler; the straw coupler further configured to couple to a straw; and a pivot rod operatively coupled to the lid coupler and to the straw coupler, the pivot rod configured to facilitate a rotation of the lid coupler relative to the straw coupler. In certain embodiments, the pivot rod provides an axis of rotation that is offset from and substantially parallel to a main axis of the straw assembly.

In some embodiments, the straw assembly can further include a valve and/or gasket retained in the lid coupler. In one embodiment, the straw assembly can further include a seal retained in the straw coupler. In certain embodiments, the lid coupler can include a lid coupler hook, the straw coupler can include a straw coupler hook, and the lid coupler hook and the straw coupler hook are configured to be removably coupled to one another.

In one embodiment, the straw coupler can include a stop configured to stop a full rotation of the lid coupler relative to the straw coupler. In some embodiments, the lid coupler base is configured to retain a gasket. In certain embodiments, the straw coupler base is configured to retain a seal.

Yet another aspect of the invention is directed to a straw and lid assembly for use with a water bottle. In one embodiment, the straw and lid assembly can include a lid for the water bottle and a straw assembly coupled to the lid. The lid can include a spout collar; a spout coupled to the spout collar; a link coupled to the spout collar; and a spout cover coupled to the link. The spout collar, link, and spout cover are configured such that from a stowed position of the spout, an initial rotation of the spout collar in a first direction causes, via the link, the spout cover to rotate in a second direction, said first direction being towards an in-use position of the spout, said second direction being counter to the first direction; a further rotation of the spout collar in the first direction causes, via the link, the spout cover to rotate in a third direction, said third direction being rotationally in the same direction as the first direction; from the in-use position of the spout, an initial rotation of the spout collar in a fourth direction causes, via the link, the spout cover to rotate in a fifth direction, said fourth direction being towards an stowed position of the spout, said fifth direction being rotationally in the same direction as the fourth direction; a further rotation of the spout collar in the fourth direction causes, via the link, the spout cover to rotate in a sixth direction, said sixth direction being counter to the fifth direction; in the in-use position of the spout, the spout cover is in a closed position and covers a space that is occupied by the spout when the spout is in the stowed position; in the stowed position of the spout, the spout cover is in a closed position covering the spout. The straw assembly can include a lid coupler configured to operatively couple to a fluid passageway of the lid; a straw coupler configured to operatively couple to the fluid passageway and to the lid coupler; the straw coupler further configured to couple to a straw; and a pivot rod operatively coupled to the lid coupler and to the straw coupler, the pivot rod configured to facilitate a rotation of the lid coupler relative to the straw coupler. In some embodiments, the pivot rod provides an axis of rotation that is offset from and substantially parallel to a main axis of the straw assembly. In certain embodiments, the straw assembly can further include a valve and/or a gasket retained in the lid coupler. In one embodiment, the straw assembly can further include a seal retained in the straw coupler.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
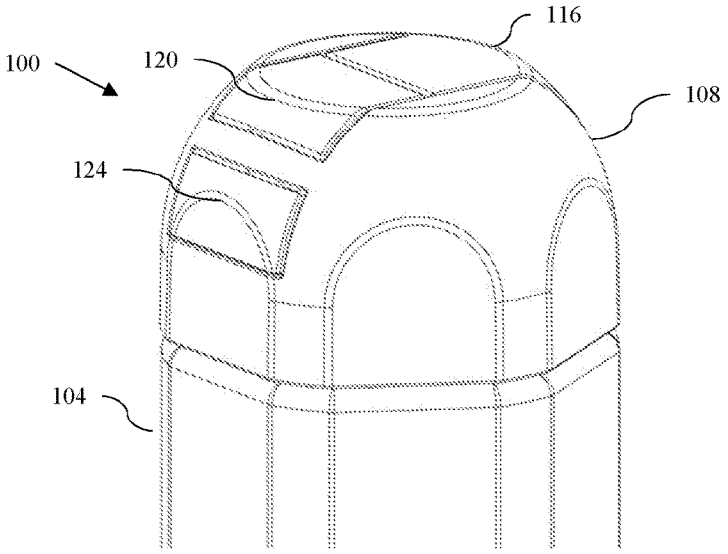
FIG. 1 is a partial, perspective view of a container having a lid in accordance with one embodiment of the invention. The container is illustrated having a spout in a stowed position.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Figure 2:
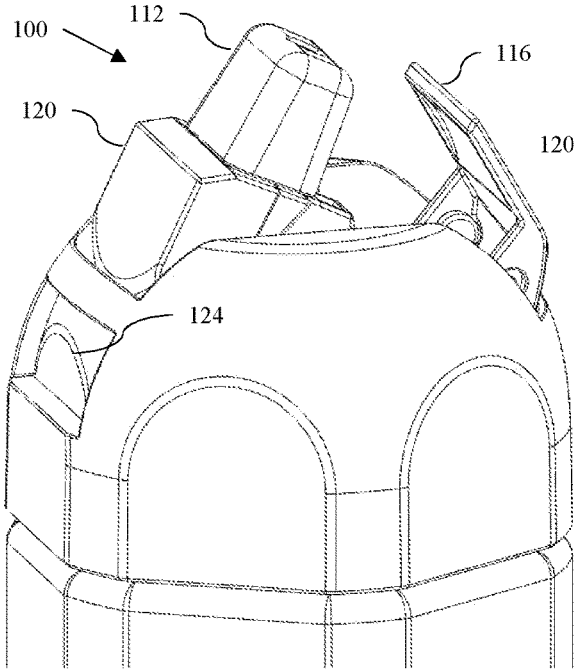
FIG. 2 is another perspective view of the container of FIG. 1 having the spout in an intermediate position between an in-use position and the stowed position.
Figure 3:
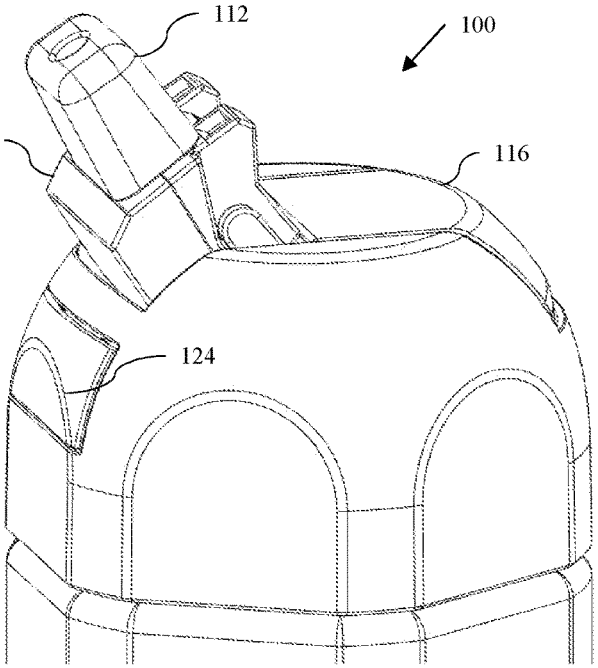
FIG. 3 is another perspective view of the container of FIG. 1 having the spout in an in-use position.

Referencing FIG. 1 through FIG. 3, one embodiment of the invention is directed to container 100 having containing body 104 and lid 108. Containing body 104 can be, for example, a bottle, a cup, a mug, a tumbler, or the like. Lid 108 can be removable from containing body 104. In one embodiment, lid 108 can be coupled to containing body 104 via a threaded engagement. In other embodiments, lid 108 can be coupled to containing body 104 via a snap fit or other suitable engagements.

FIG. 1 shows container 100 in a stowed configuration wherein spout 112 is covered by spout cover 116. Spout collar 120 engages a lower portion of spout 112 and forms part of lid 108 to maintain spout 112 covered and inside an internal space of lid 108. In one embodiment, actuator 124 can be provided to actuate a release of spout 112 via, for example, a disengagement of actuator 124 and spout collar 120. As shown in FIG. 2, a translation of actuator 124 inwardly causes spout 112 to emerge from an internal space of lid 108, and spout cover 116 rotates away from spout 112. As shown in FIG. 3, in an in-use position, spout 112 is in a position for dispensing contents from container 100, and spout cover 116 has rotated toward spout 112 to a closed position. Thus, both during the in-use position and in the stowed position spout cover 116 is in a closed position. In one embodiment, spout cover 116 is opened only while spout 112 is emerging from lid 108 to move to an in-use position or while spout 112 is returning into lid 108 to move to the stowed position. This configuration is advantageous in preventing dirt (for example) from entering the inside of lid 108 while spout 112 is an in-use position.

Figure 4:
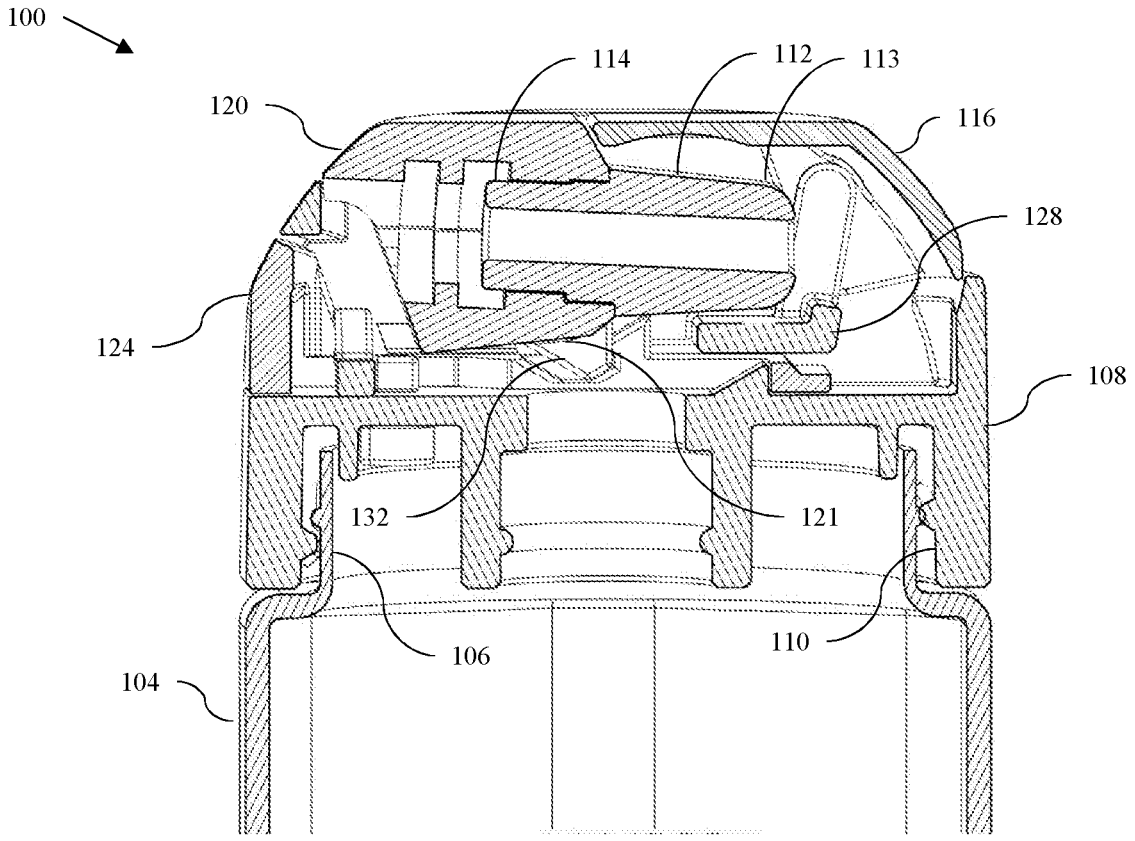
FIG. 4 is a cross-sectional view of the container of FIG. 1 with the spout in a stowed position.
Figure 5:
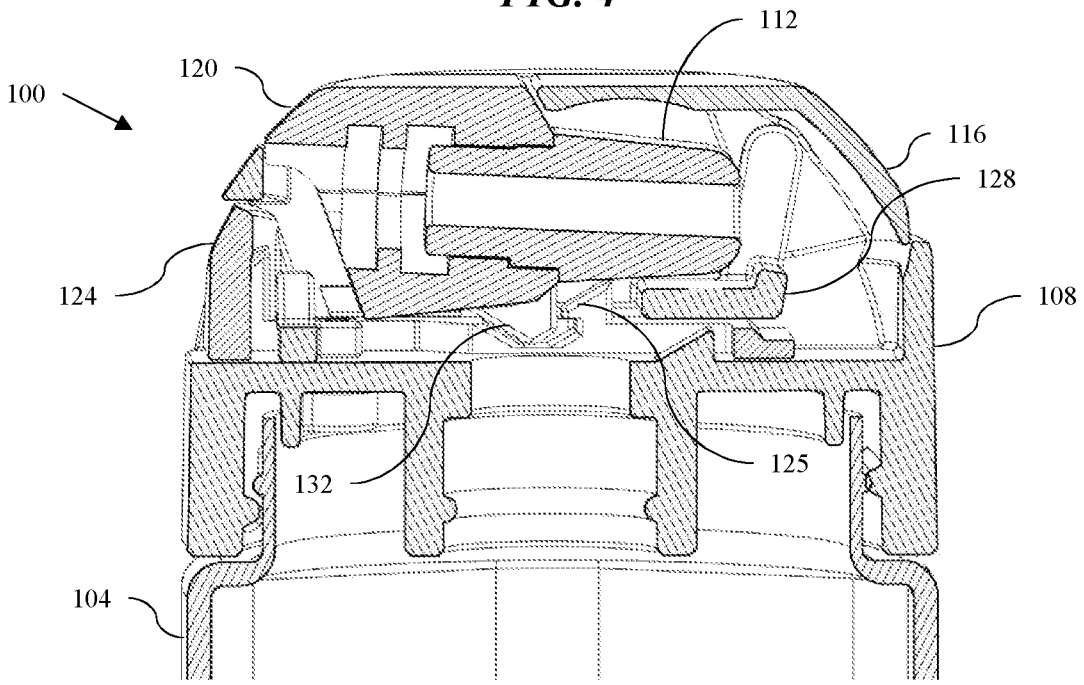
FIG. 5 is another cross-sectional view of the container of FIG. 1 illustrating a disengagement of an actuator from a spout collar.

Referencing FIG. 4, in one embodiment container 100 can include containing body 104 having containing body threads 106 for engaging corresponding lid threads 110. In one embodiment, spout 112 can include spout upper portion 113 and spout lower portion 114. In some embodiments, spout lower portion 114 is configured to engage collar upper portion 121. In certain embodiments, link 128 is configured to operatively couple spout collar 120 with spout cover 116. As will be discussed in greater detail below, spout 112, spout cover 116, and link 128 are operatively configured to cause spout cover 116 to open away from spout 112 as spout 112 emerges from lid 108 (see FIG. 2), and to rotate back towards spout 112 as spout 112 is positioned in the in-use position (see FIG. 3). FIG. 5 shows actuator 124 moved partially inward toward the center axis of container 100, which causes actuator hook 125 to begin to disengage collar catch 132. In some embodiments, a biasing element (not shown) can be provided to bias actuator 124 towards the outer edge of lid 108. These biasing elements and configurations are well known in the relevant technology. For example, a spring (not shown) can be coupled between actuator 124 and a fixed part of lid 108.

Figure 6:
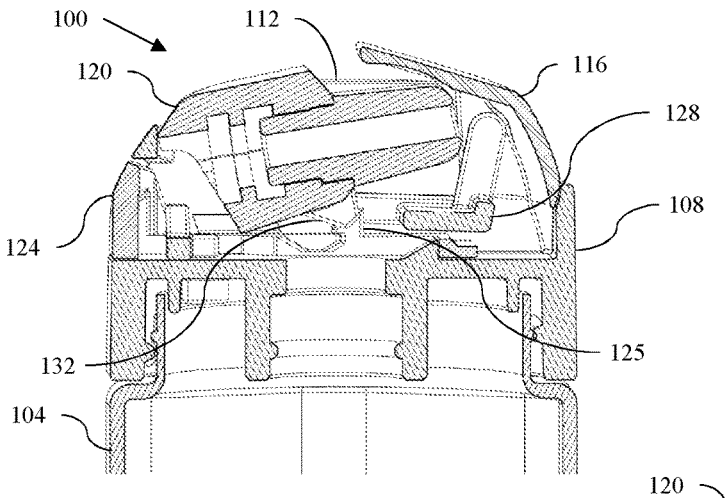
FIG. 6 is another cross-sectional view of the container of FIG. 1 illustrating an initial movement of a spout collar from the stowed position of the spout toward an in-use position of the spout.
Figure 7:
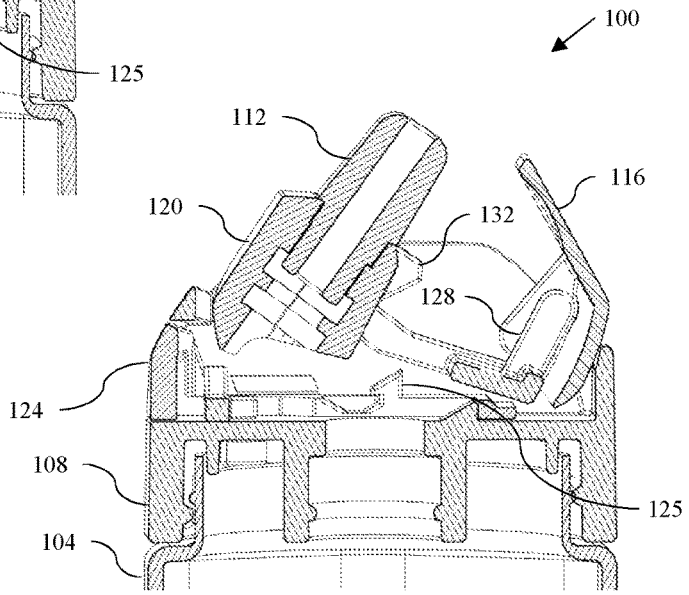
FIG. 7 is another cross-sectional view of the container of FIG. 1 illustrating a further movement of the spout collar toward an in-use position of the spout.
Figure 8:
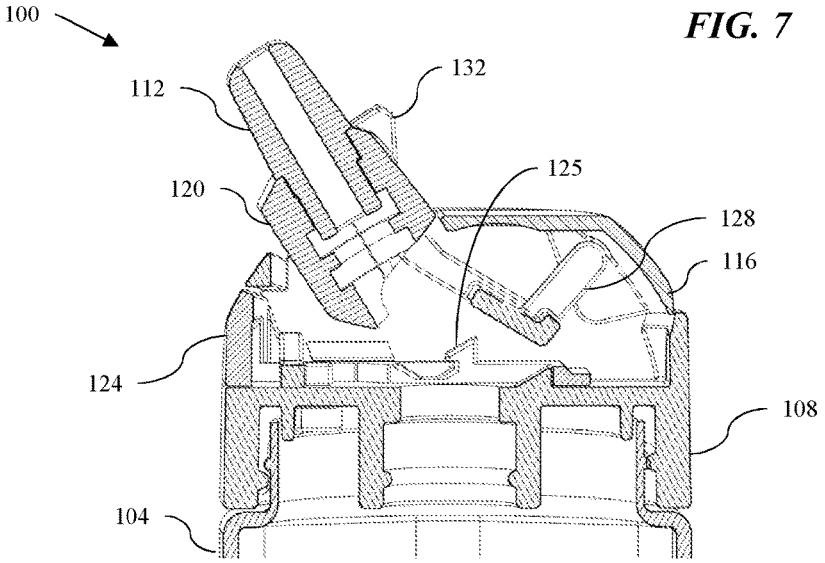
FIG. 8 is another cross-sectional view of the container of FIG. 1 illustrating the spout in an in-use position.
Figure 9:
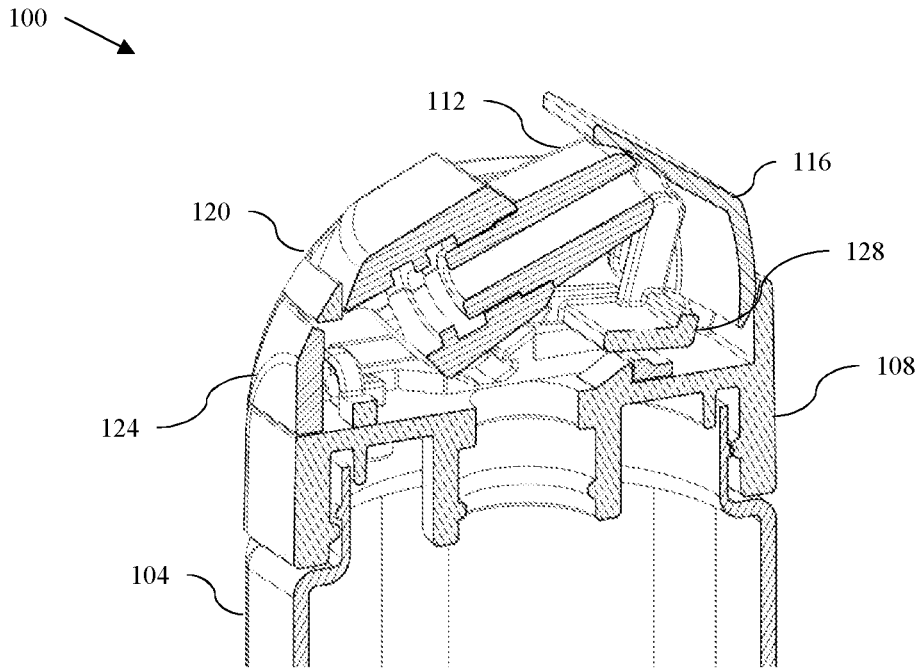
FIG. 9 is perspective, cross-sectional view of the container of FIG. 1 illustrating the spout and spout cover in an intermediate position between an in-use position and a stowed position.
Figure 10:
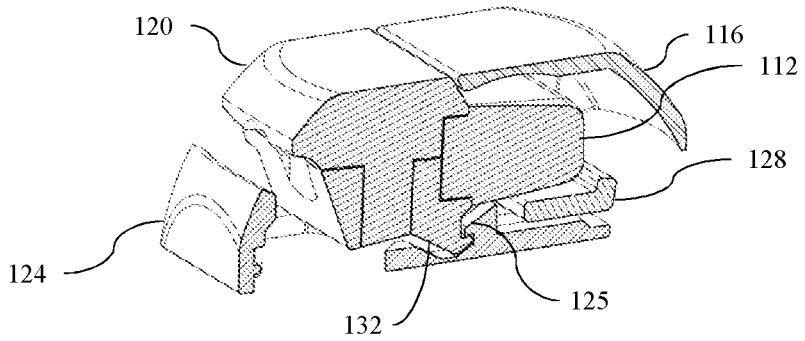
FIG. 10 is a perspective, cross-sectional view of the container of FIG. 1 illustrating one embodiments of an engagement between an actuator and the spout collar.
Figure 15:
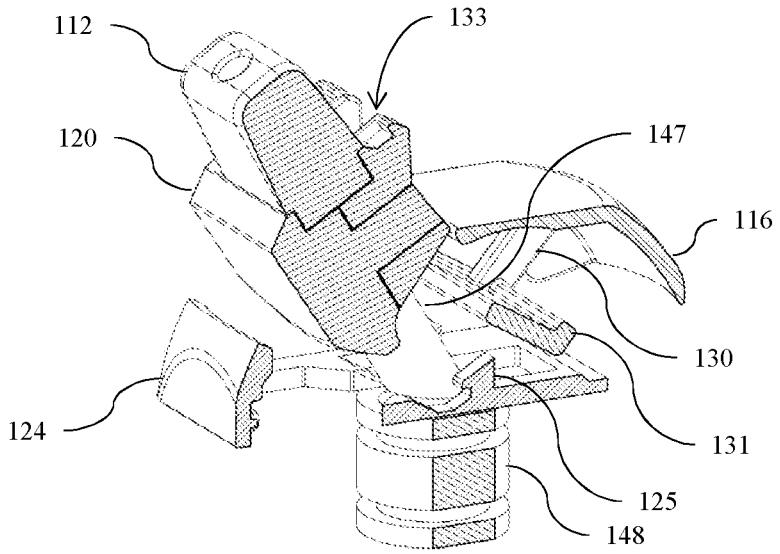
FIG. 15 is a perspective, cross-sectional view of the components of FIG. 11 illustrating the spout and spout cover in an in-use position.
Figure 16:
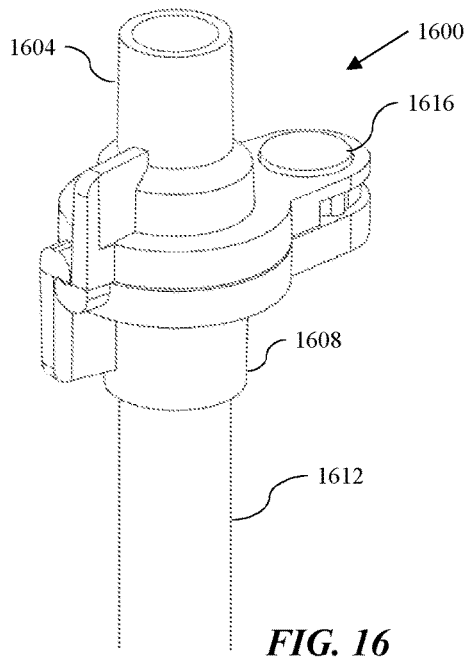
FIG. 16 is a perspective view of a straw assembly in accordance with one embodiment of the invention.
Figure 17:
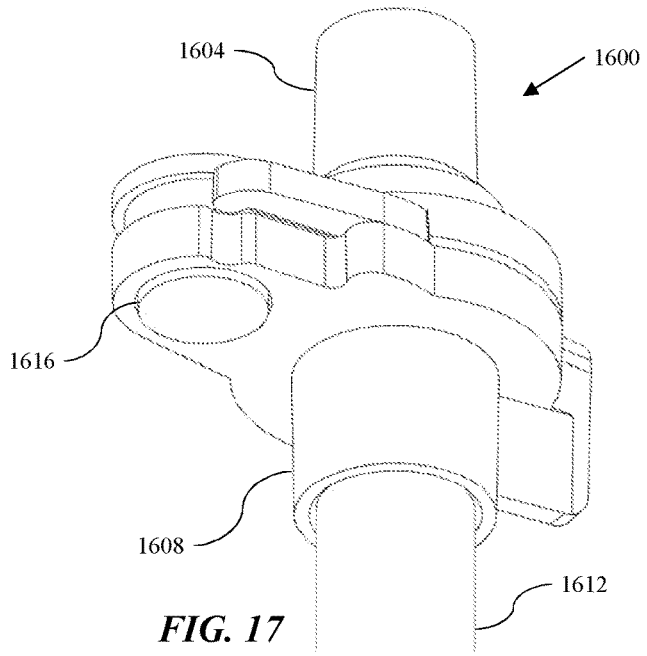
FIG. 17 is another perspective view of the straw assembly of FIG. 16.
Figure 18:
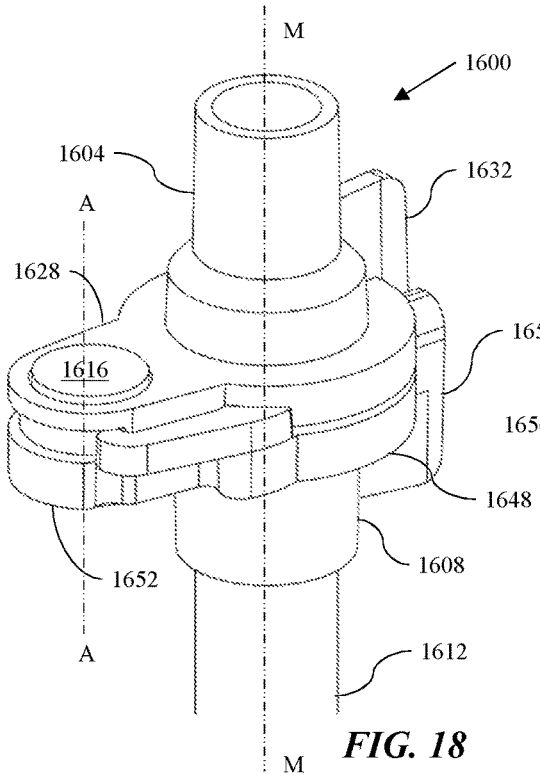
FIG. 18 is another perspective view of the straw assembly of FIG. 16.
Figure 19:
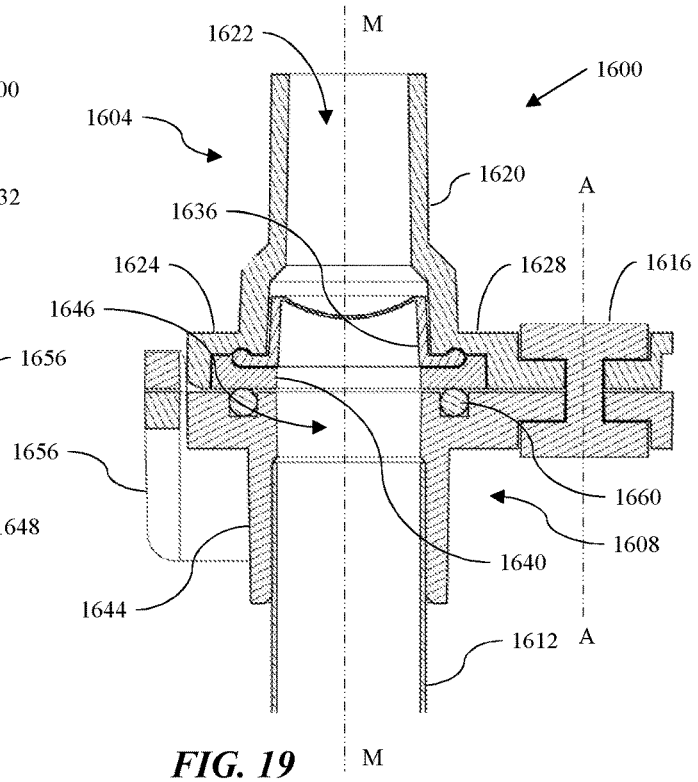
FIG. 19 is cross sectional view of the straw assembly of FIG. 16.
Figure 20:
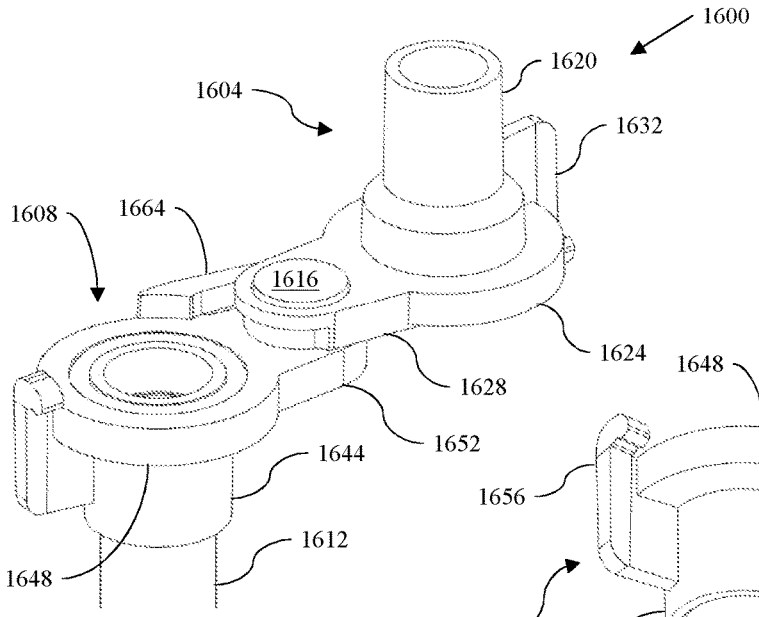
FIG. 20 is another perspective view of the straw assembly of FIG. 16.

Referencing FIG. 6 through FIG. 8 now, in one embodiment, after actuator hook 125 disengages collar catch 132, spout 112 begins to emerge from an inner space of lid 108. Through link 128, the movement of spout 112 causes spout cover 116 to begin rotation towards on open position (see FIG. 6). Further rotation of spout 112 towards an in-use position causes, via link 128, spout cover 116 to rotate away from spout 112 and towards a fully open position of spout cover 116 (see FIG. 7). Additional rotation of spout 112 to an in-use position causes spout cover 116, via link 128, to revert back to a closed position, and thereby, cover the inner space of lid 108 previously occupied by spout 112. FIG. 9 illustrates, among other things, spout 112 as spout 112 is rotated toward a stowed position. As depicted, as spout 112 is returned to the stowed position spout cover 116 rotates toward the center of container 100 to cover spout 112. FIG. 10 illustrates, among other things, in cross-section the engagement of actuator hook 125 with collar catch 132. Movement of spout 112 and/or spout collar 120 can be aided through methods well known in the relevant technology. For example, in one embodiment, straw 147 of suitable resilient material can be coupled to spout 112 and/or spout collar 120 (see FIG. 15). Deformation of straw 147 can provide a bias, for example, toward moving spout 112 and/or spout collar 120 toward the in-use position. Manual movement of spout collar 120 into the stowed position causes collar catch 132 to engage actuator hook 125 and, hence, keep spout collar 120 and spout 112 securely stowed within lid 108.

Figure 11:
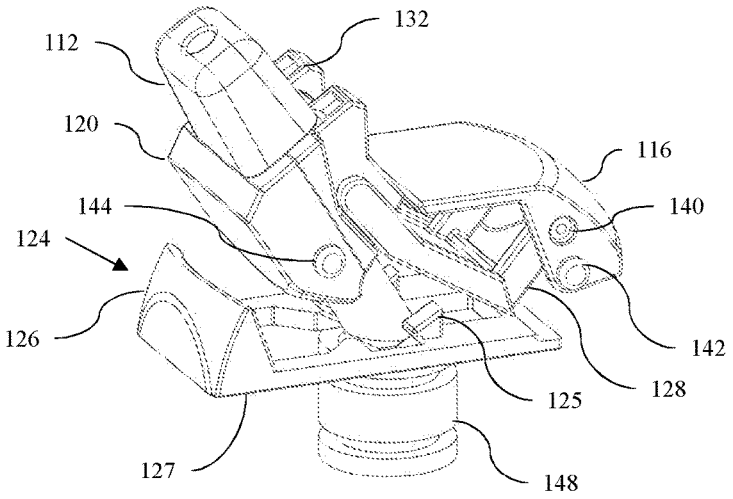
FIG. 11 is a perspective view of certain components of the container of FIG. 1 illustrating the spout in an in-use position.
Figure 12:
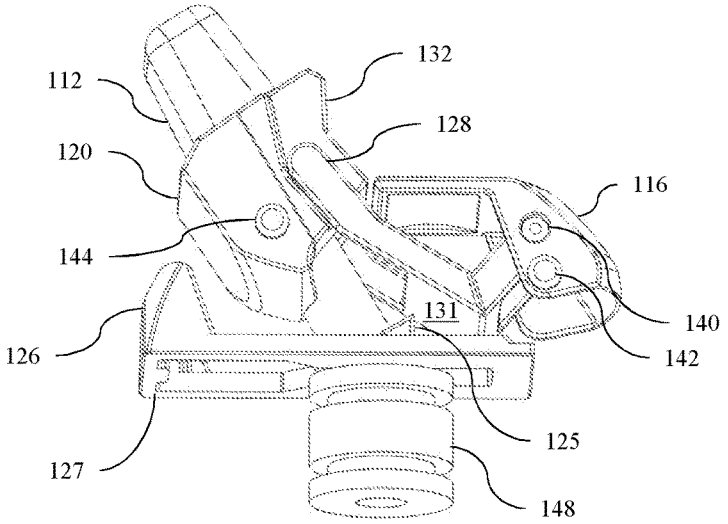
FIG. 12 is another perspective view of the components of FIG. 11.
Figure 12A:
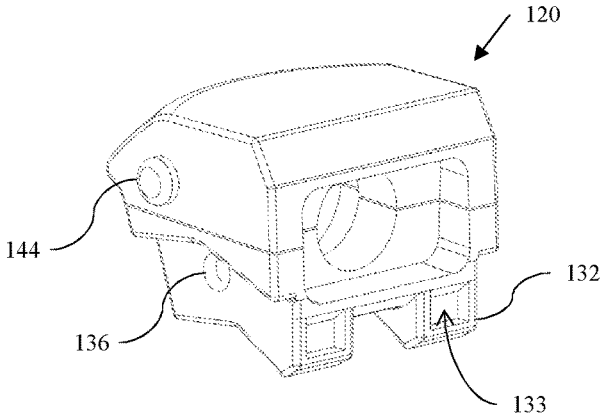
FIG. 12A is a perspective view of a spout collar according to one embodiment of the invention.

Referencing FIG. 11, FIG. 12, and FIG. 12A, in one embodiment actuator 124 can include actuator button 126 operatively coupled to actuator hook 125 via, for example, actuator base 127. When actuator button 126 is pressed radially inward, toward a center axis of seal 148, actuator hook 125 disengages collar catch 132 (see partial disengagement in FIG. 5). In certain embodiments, spout collar 120 can be provided with collar pivot 144, which is configured to facilitate a rotation of spout collar 120 (and, consequently, of spout 112) about collar pivot 144. Spout collar 120 can be provided with collar link attachment 136 for engaging with collar link pivot 129E (see FIG. 13A). In one embodiment, spout cover 116 can be provided with spout cover pivot 142 configured to facilitate a rotation of spout cover 116 about spout cover pivot 142. In some embodiments, link 128 is operatively coupled to spout cover 116 via link pivot 140. As illustrated in FIG. 11, in one embodiment, link 128 couples to spout collar 120 and to spout cover 116 at locations other than collar pivot 144 and spout cover pivot 142.

Figure 13:
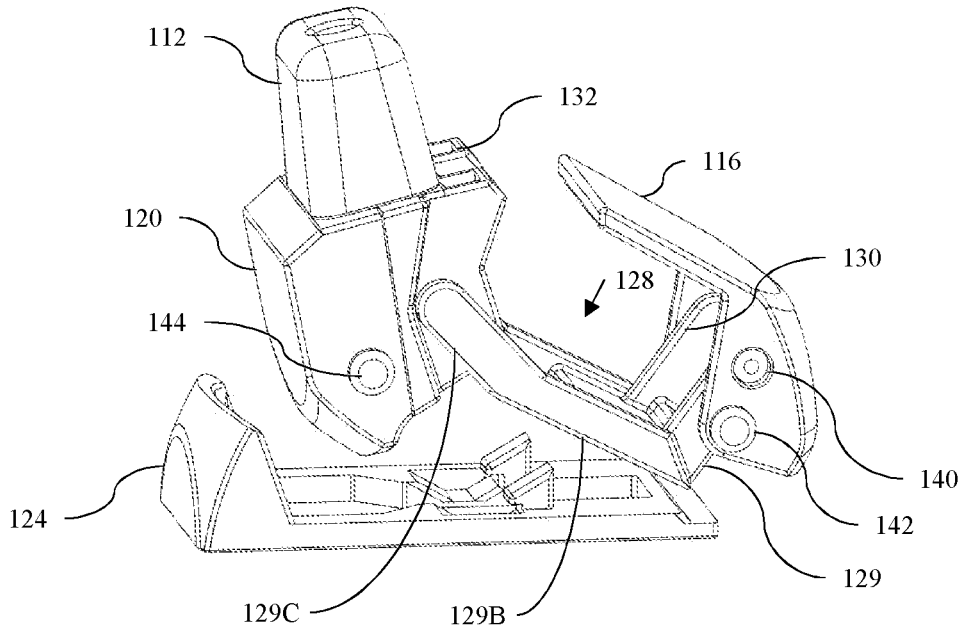
FIG. 13 is another perspective view of the components of FIG. 11 illustrating the spout and the spout cover in an intermediate position between an in-use position and a stowed position.
Figure 13A:
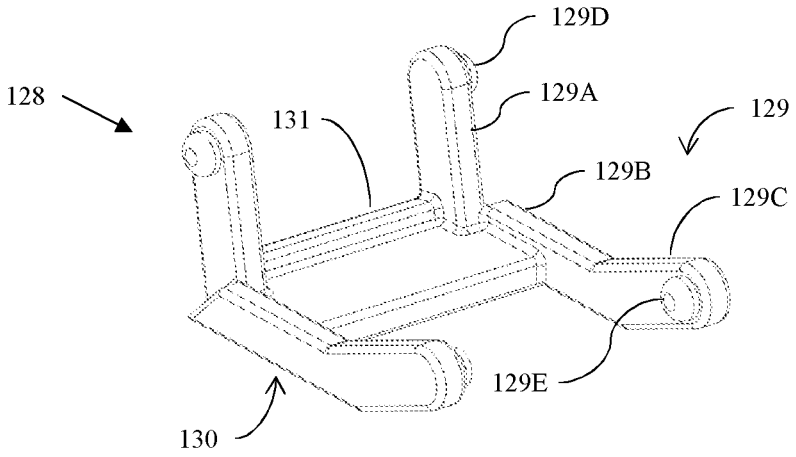
FIG. 13A is a perspective view of a link for use with a lid according to one embodiment of the invention.
Figure 14:
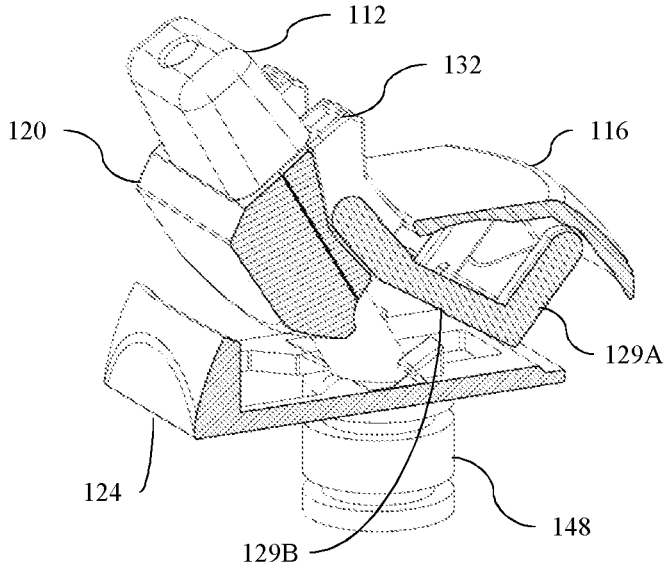
FIG. 14 is a perspective, cross-sectional view of the components of FIG. 11 illustrating one embodiment of a link operatively coupling the spout collar and the spout cover.

Referencing FIG. 13, FIG. 13A, and FIG. 14, in one embodiment link 128 can include first link arm 129 and second link arm 130, and first link arm 129 can be operatively coupled to second link arm 130 through link cross-piece 131 (see FIG. 12). In some embodiments first link arm 129 can include cover extension 129A coupled to link pivot 140 and to collar extension 129B. In some embodiments, cover extension 129A and collar extension 129B are one integral piece that has a generally l-shape. In certain embodiments, collar extension 129B has extension distal end 129C that is a portion of collar extension 129B; extension distal end 129C, in some embodiments, bends at an angle relatively to a longitudinal axis of collar extension 129B. In some embodiments, cover extension 129A includes cover link pivot 129D for engaging with link pivot 140. Collar extension 129B can include collar link pivot 129E for engaging with collar link attachment 136. In certain embodiments, second link arm 130 is similarly shaped and configured as first link arm 129. Referencing FIG. 15, in one embodiment, collar catch 132 includes catch cavity 133 configured to engage with actuator hook 125.

Referencing FIG. 16 through FIG. 23, one embodiment of the invention is directed to straw assembly 1600 that can be used, for example, with lid 108. In one embodiment, straw assembly 1600 can include lid coupler 1604 operatively coupled to straw coupler 1608. Lid coupler 1604 can be configured for coupling to lid 108 (see FIG. 23). Straw coupler 1608 can be configured for coupling to straw 1612. Lid coupler 1604 and straw coupler 1608 can be made of any suitable material such as, for example, plastic, metal, and/or composite. In one embodiment, lid coupler 1604 and straw coupler 1608 are operatively coupled with pivot rod 1616.

Figure 21:
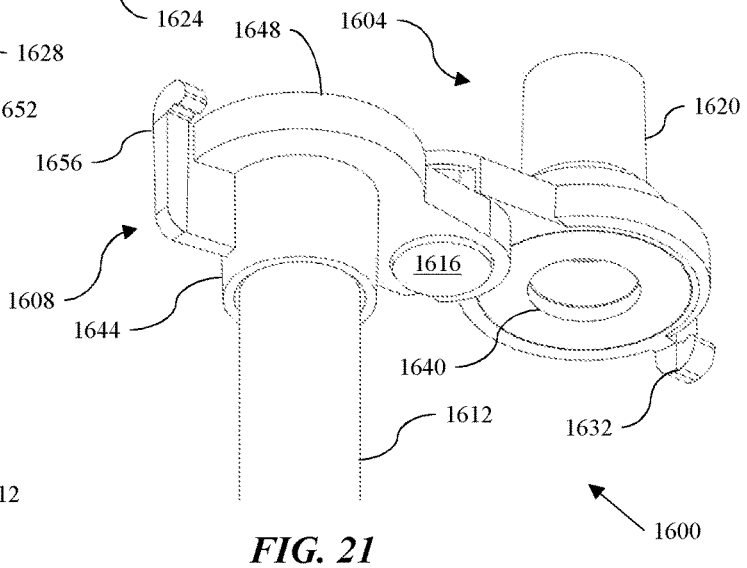
FIG. 21 is another perspective view of the straw assembly of FIG. 16.
Figure 22:
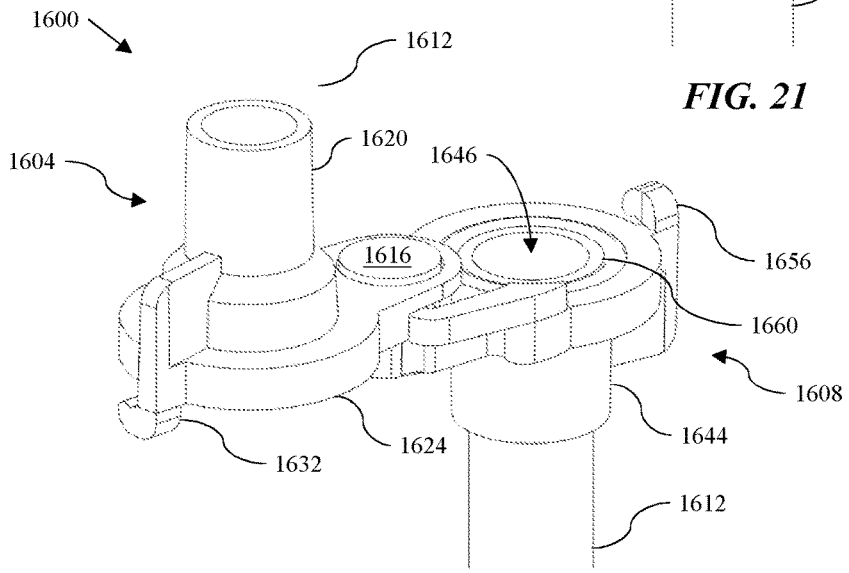
FIG. 22 is another perspective view of the straw assembly of FIG. 16.
Figure 23:
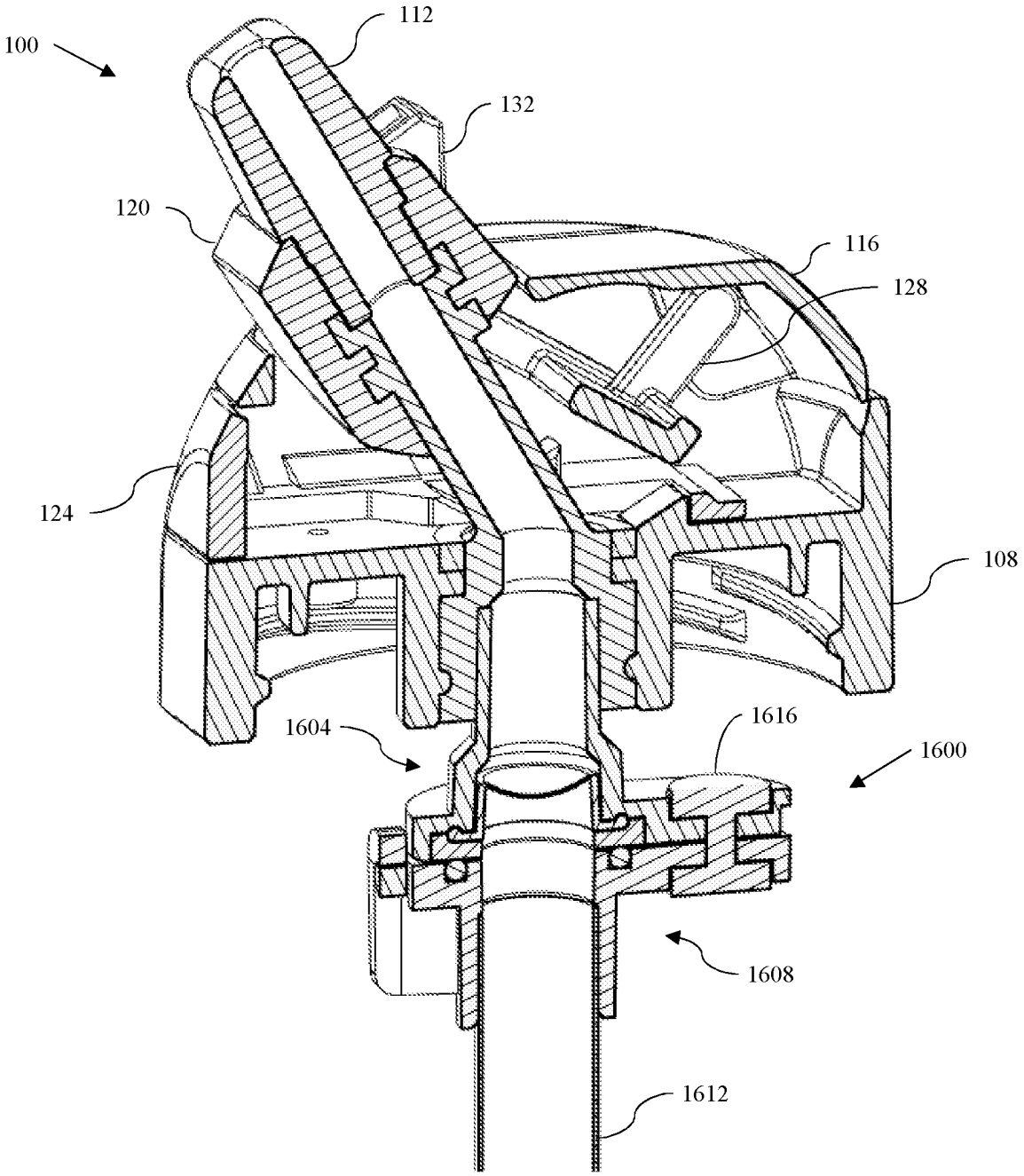
FIG. 23 is a cross-sectional, perspective view of a lid and straw assembly according to one embodiment of the invention.

Referencing FIG. 21 through FIG. 22 particularly, in one embodiment lid coupler 1604 can include lid coupler tube 1620 coupled to lid coupler base 1624. Lid coupler tube 1620 can include passageway 1622 for allowing the flow of, for example, fluid there through. Lid coupler base 1624 can include lid coupler base extension 1628 configured with an orifice (not shown) for receiving pivot rod 1616. In one embodiment, lid coupler 1604 can include lid coupler hook 1632 that can be coupled to lid coupler tube 1620 and/or lid coupler base 1624. Lid coupler hook 1632 can be provided integrated with lid coupler tube 1620 and/or lid coupler base 1624.

One end of lid coupler tube 1620 can be configured to receive and house at least part of, for example, valve 1636. In some embodiments, lid coupler base 1624 can be configured to receive, house, and/or retain part of, for example, valve 1363 (see FIG. 19). In certain embodiments, lid coupler base 1624 can be configured to receive, store, and/or retain gasket 1640, for example. In some embodiments, lid coupler tube 1620 and lid coupler base 1624 can be made as an integrated, single component having a suitable cavity for receiving and/or retaining valve 1636 and/or gasket 1640.

In one embodiment, straw coupler 1608 can include straw coupler tube 1644 coupled to straw coupler base 1648. Straw coupler tube 1644 can include passageway 1646 for allowing the flow of, for example, fluid there through. Straw coupler base 1648 can include straw coupler base extension 1652 configured with an orifice (not shown) for receiving pivot rod 1616. Lid coupler base extension 1628 and straw coupler extension 1652 are arranged to facilitate a rotation of lid coupler 1604 relative to straw coupler 1608 about pivot rod 1616. In one embodiment, the axis of rotation about pivot 1616 (axis A) is substantially parallel to a main axis of straw assembly 1600 (axis M). In some embodiments, straw coupler 1608 can include straw coupler hook 1656 that can be coupled to straw coupler tube 1644 and/or straw coupler base 1648. In one embodiment, straw coupler hook 1656 can be provided integrated with straw coupler tube 1644 and/or straw coupler base 1648.

In certain embodiments, straw coupler base 1648 can be configured to receive and retain seal 1660, which can be an O-ring in some applications. In one embodiment, straw coupler base 1648 can also include stop 1664, which can be a raised, elongated piece along one side of straw coupler base extension 1652, and which can be configured to provide a stop for lid coupler base 1624 and/or lid coupler base extension 1628 to prevent a full rotation of lid coupler 1604 relative to straw coupler 1608.

One exemplary method of using straw assembly 1600 can include bringing lid coupler 1604 into alignment with straw coupler 1608 and latching lid coupler hook 1632 to straw coupler hook 1656 to thereby provide a passage for flow of fluid via passageway 1646 and passageway 1622. Alignment of lid coupler 1604 with straw coupler 1608 can be facilitated via rotation of lid coupler 1604 relative to straw coupler 1608 using pivot rod 1616, which operatively couples lid coupler 1604 to straw coupler 1608. The surface of lid coupler base 1624 is brought flush with the surface of straw coupler base 1648 and, thereby, a sealed interface is achieved. Next, straw 1612 can be coupled (such as fitted) to an inner tubular portion of straw coupler 1608. Straw assembly 1600 can then be coupled to lid 100 for use, for example, in a water bottle application (see FIG. 23).

In some cases it might be desirable to clean, repair, and/or replace one or more of valve 1636, gasket 1640, and seal 1660. In such cases, lid coupler hook 1632 can be disengaged from straw coupler hook 1656; and lid coupler 1604 can then be rotated about pivot 1616 until stopped by stop 1664. This then allows convenient access to valve 1636, gasket 1640, and/or seal 1660 for cleaning, repairing, and/or replacing.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

The invention claimed is:

1. A straw assembly comprising:

a lid coupler configured to couple to a lid of a container;

a straw coupler configured to couple to a straw, the straw coupler configured for rotation relative to the lid coupler;

a pivot rod coupled to the lid coupler and to the straw coupler, the pivot rod configured to facilitate rotation of the lid coupler relative to the straw coupler;

wherein the lid coupler comprises:

a lid coupler tube having a passageway;

a lid coupler base coupled to the lid coupler tube;

wherein the lid coupler tube and/or the lid coupler base is configured with a cavity to receive a valve;

wherein the straw coupler comprises:

a straw coupler tube having a passageway;

a straw coupler base coupled to the straw coupler tube;

wherein the straw coupler tube and/or the straw coupler base is configured with a cavity to receive a seal; and wherein the pivot rod provides an axis of rotation that is offset from and parallel to a main axis of the straw assembly.

2. The straw assembly of claim 1, wherein the lid coupler further comprises a lid coupler hook, the straw coupler comprises a straw coupler hook, and wherein the lid coupler hook and the straw coupler hook are configured to be removably coupled to one another.

3. The straw assembly of claim 1, wherein the straw coupler further comprises a stop configured to stop a full rotation of the lid coupler relative to the straw coupler.

4. The straw assembly of claim 1, wherein the lid coupler tube and/or the lid coupler base is further configured to receive a gasket.

5. The straw assembly of claim 1, wherein the lid coupler base comprises a lid coupler base extension, wherein the straw coupler base comprises a straw coupler base extension, and wherein the lid coupler base extension and the straw coupler base extension are each configured to receive the pivot rod, and thereby operationally couple the lid coupler with the straw coupler.

6. A straw assembly for use with a portable water bottle, the straw assembly comprising:

a lid coupler configured to operatively couple to a fluid passageway of a lid of the portable water bottle;

a straw coupler configured to operatively couple to the fluid passageway and to the lid coupler; the straw coupler further configured to couple to a straw;

a pivot rod operatively coupled to the lid coupler and to the straw coupler, the pivot rod configured to facilitate a rotation of the lid coupler relative to the straw coupler; and wherein the pivot rod provides an axis of rotation that is offset from and parallel to a main axis of the straw assembly.

7. The straw assembly of claim 6, further comprising a valve retained in the lid coupler.

8. The straw assembly of claim 7, further comprising a gasket retained in the lid coupler.

9. The straw assembly of claim 8, further comprising a seal retained in the straw coupler.

10. The straw assembly of claim 6, wherein the lid coupler comprises a lid coupler hook, the straw coupler comprises a straw coupler hook, and wherein the lid coupler hook and the straw coupler hook are configured to be removably coupled to one another.

11. The straw assembly of claim 6, wherein the straw coupler comprises a stop configured to stop a full rotation of the lid coupler relative to the straw coupler.

12. The straw assembly of claim 6, wherein the lid coupler comprises a lid coupler base coupled to a lid coupler tube.

13. The straw assembly of claim 12, wherein the lid coupler base is configured to retain a gasket.

14. The straw assembly of claim 6, wherein the straw coupler comprises a straw coupler base coupled to a straw coupler tube.

15. The straw assembly of claim 14, wherein the straw coupler base is configured to retain a seal.

16. A straw and lid assembly for use with a water bottle, the straw and lid assembly comprising:

a lid for the water bottle;

a straw assembly coupled to the lid;

wherein the lid comprises:

a spout collar;

a spout coupled to the spout collar;

a link coupled to the spout collar;

a spout cover coupled to the link;

wherein from a stowed position of the spout, an initial rotation of the spout collar in a first direction causes, via the link, the spout cover to rotate in a second direction, said first direction being towards an in-use position of the spout, said second direction being counter to the first direction;

wherein a further rotation of the spout collar in the first direction causes, via the link, the spout cover to rotate in a third direction, said third direction being rotationally in the same direction as the first direction;

wherein from the in-use position of the spout, an initial rotation of the spout collar in a fourth direction causes, via the link, the spout cover to rotate in a fifth direction, said fourth direction being towards an stowed position of the spout, said fifth direction being rotationally in the same direction as the fourth direction;

wherein a further rotation of the spout collar in the fourth direction causes, via the link, the spout cover to rotate in a sixth direction, said sixth direction being counter to the fifth direction;

wherein, in the in-use position of the spout, the spout cover is in a closed position and covers a space that is occupied by the spout when the spout is in the stowed position;

wherein, in the stowed position of the spout, the spout cover is in a closed position covering the spout;

wherein the straw assembly comprises:

a lid coupler configured to operatively couple to a fluid passageway of the lid;

a straw coupler configured to operatively couple to the fluid passageway and to the lid coupler; the straw coupler further configured to couple to a straw; and a pivot rod operatively coupled to the lid coupler and to the straw coupler, the pivot rod configured to facilitate a rotation of the lid coupler relative to the straw coupler.

17. The straw and lid assembly of claim 16, wherein the pivot rod provides an axis of rotation that is offset from and parallel to a main axis of the straw assembly.

18. The straw and lid assembly of claim 17, the straw assembly further comprising a valve and a gasket retained in the lid coupler.

19. The straw assembly of claim 18, further comprising a seal retained in the straw coupler.

* * * * *